United States Patent [19]

Kohl

[11] 4,141,230

[45] Feb. 27, 1979

[54] JACQUARD CONTROLLED WARP KNITTING MACHINE WITH SLIDABLE THREAD GUIDES

[75] Inventor: Karl Kohl, Obertshausen, Fed. Rep. of Germany

[73] Assignee: Karl Mayer Textilmaschinen Fabrik GmbH, Obertshausen, Fed. Rep. of Germany

[21] Appl. No.: 877,599

[22] Filed: Feb. 14, 1978

[30] Foreign Application Priority Data

Feb. 18, 1977 [DE] Fed. Rep. of Germany ..... 2707015

[51] Int. Cl.[2] ..... D04B 23/00; D04B 27/00

[52] U.S. Cl. ..... 66/204

[58] Field of Search ..... 66/207, 203, 204, 205, 66/125, 206, 208

[56] References Cited

U.S. PATENT DOCUMENTS 3,952,549 4/1976 Kohl ..... 66/207

FOREIGN PATENT DOCUMENTS 545217 2/1932 Fed. Rep. of Germany ..... 66/203

29221 6/1964 German Democratic Rep. ..... 66/203

*Primary Examiner*—Ronald Feldbaum

*Attorney, Agent, or Firm*—Omri M. Behr

[57] ABSTRACT

There is provided an improved jacquard controlled warp knitting machine having ground stitch guides and jacquard controlled pattern guides. The improved feature lies in the slidable mounting of the jacquard controlled guides on their pattern guide bar and the control of the distance said guides may slide on said bar by the action of the jacquard dropper bars and of clamping means.

9 Claims, 2 Drawing Figures

JACQUARD CONTROLLED WARP KNITTING MACHINE WITH SLIDABLE THREAD GUIDES

BACKGROUND OF THE INVENTION

Heretofore, in order to achieve a patterned effect, in particular with certain materials, it has been conventional to work with pattern guide bars which are steered in the traverse direction with pattern chains and which are equipped with guides to guide the pattern threads. These machines are rather limited in the type of pattern which they can achieve since the sidewards path available to the guide bars is rather limited. Further, it is rather difficult to work with one pattern repeat since this requires the use of a very long pattern chain.

In order to avoid the foregoing problems, it has been conventional to utilize machines equipped with a jacquard arrangement. In such equipment in place of using guide bars with individual thread guides, there is utilized a jacquard bar which operates together with displacement droppers whereby each needle works with one or more pattern threads. The patterning is achieved in that the jacquard pattern thread is moved from one needle to another depending on whether the pattern effect or the basic motif of the ware should appear on the one hand and is worked with the ground stitches when the motif is not to be apparent.

The disadvantage of this type of equipment is that it is necessary to provide as many pattern threads as there are needles in the machine and that a plurality of pattern threads must be worked into the ground stitches. The over-all effect thereof is that the ground stitches, which carry no pattern are in fact heavier than necessary. The contrast between the ground stitches and the pattern effect is substantially more undesirable in this particular type of operation than in the equipment of the first type mentioned herein above.

SUMMARY OF THE INVENTION

In order to avoid the disadvantages of the conventional jacquard system there are provided, in the machines of the present invention on at least one guide bar, a plurality of guides, which are slidably displaceable in relation to the guide bar itself and whose predetermined degree of traverse motion is determined by contact tabs controlled from the jacquard heads. This pattern guide bar can then, which simplifies procedures greatly, be driven in a single, pre-selected, constant traverse motion cycle by the use of, for example, only an eccentric cam.

The pattern guide bar executes a constant predetermined traverse motion. The thread guides are so attached to the bar itself that while they are carried along by the sidewards traverse of the bar itself, when they reach a pre-determined point, they are held at that point by a pre-programmed jacquard controlled striker tab. These striker tabs may be attached to a separate bar, designated the tab bar and are controlled by the jacquard arrangement.

It is thus achieved that single, adjacent thread guides can perform underlaps of different lengths. The individual thread guide can be clamped onto the pattern guide bar by a clamping means, suitably mechanical, electromagnetic, or the like. Most suitably a lifting magnet is provided so that at the start of the traverse motion the thread guides are clamped onto the pattern guide bar. Upon reaching a jacquard control tab, an electrical contact is activated which deactivates the magnet and precipitates a decoupling action, so that the thread guide remains in this setting while the pattern guide bar itself completes the rest of its motion. After the pattern bar reaches this end point all magnets are again activated so that the thread guides are again clamped onto the guide bar and cannot displace themselves during the swing through the needle bed. The separate tab bar is displaced sideward by an amount corresponding to the thickness of the tab so that the path of the thread guides corresponds exactly to the separation between the needles. If it is considered desirable, a swinging motion of the tab bar can also be provided. In accordance with the predetermined program the tabs themselves can be taken in or out of contact position by operation of the jacquard arrangement. The traverse displacement of the thread guide bar is chosen to be somewhat greater than the maximum underlap that is to be performed by the thread guides.

In the machines equipped in accordance with the present invention only one pattern thread is utilized for each displacement path of a thread guide between the pattern motif of the ware. Thus the ground stitches which contain no pattern for all intents and purposes do not contain any pattern threads.

In a further embodiment of the invention it has been found useful to provide the moveable thread guides on two separate pattern guide bars wherein on one bar the guide bar is moveable and clampable in one direction and on the other in the other direction. In addition thereto the jacquard head can be programmed not only to control the tabs but also the clamping and unclamping means acting between the thread guides and thread guide bar. There is illustrated hereinbelow one mode of operation of the apparatus of the present invention.

DETAILED DESCRIPTION OF A PREFERRED EMBODIMENT

Figure 1:
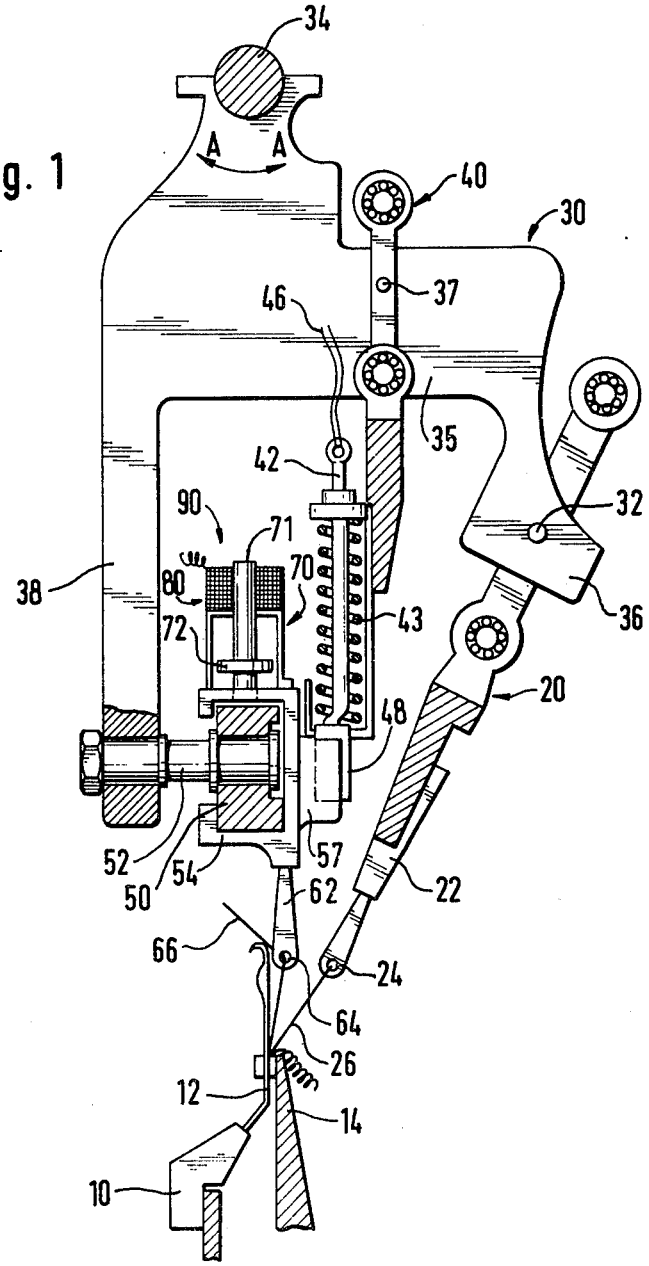
FIG. 1 is a schematic elevational cross sectional view of the guide bars and mounting arrangement therefor of the present invention viewed in the traverse direction.

FIG. 1 shows the mutual relationship of the pattern guides and their guide bar, the jacquard tab bar and its droppers and the ground stitch bar in relationship to each other and the needle bed.

The entire guide bar arrangement is mounted on superstructure 30 which itself is mounted on beam 34 and swingable about the axis 34 substantially in the direction of arrows AA. Superstructure 30 comprises at least three main segments. A transverse segment 35 and a pair of downwardly directed segments 36 and 38. Ground stitch guide bar 20 is attached to segment 36 at point 32. Guides 22 are attached to bar 20. Threads 26 pass through eyelets 24 and are knitted about needles 12 attached to needle bed 10 and the thus formed stitches knocked over on sinkers 14.

The tab bar 40 carrying the jacquard controlled droppers 42 is attached transverse segment 35 at point 37. The droppers 42 are controlled by strings 46 acting against springs 43, are in turn connected to the jacquard arrangement itself which is not illustrated. The lower ends of droppers 42 are provided with jacquard tabs 48.

The pattern guide bar 50 is connected to but separated from segment 38 by coupling and separating bolt 52. The tabbed guide carrier 54 is slidably mounted on pattern bar 50 and can slide thereon in the direction of traverse. Guides 62 are attached to guide carrier 50 which has tabs 57 attached thereto. Thread 66 passes through eyelet 64 in guide 62 whereby said thread 66 may be knitted about needle 12.

Clamping mean 70 comprising clamp 71 and means for activating same are attached to guide carrier 54. In the illustrated embodiment the clamping means 70 comprises a central clamping pole 71, a stopper tab 72, and a magnet 90. Activation and deactivation of the magnet controls the clamping and declamping action of the clamping means 70.

In a further embodiment of the invention, not illustrated herein, a second system similar to that shown can be provided between the jacquard bar 40 and the ground bar 20 so that the tabs 48 on the jacquard droppers can operate in both directions of the traverse travel.

Yet another embodiment (also not illustrated) the jacquard arrangement can be utilized to directly control clamping means 70.

In the operation of the embodiment of the present invention as illustrated the thread guides 62 for the pattern thread 66 mounted on the pattern guide bar 50 are moveable thereon in the traverse direction. These thread guides work with the needles 12 on needle bed 10. The pattern guide bar 50 is displaceable in traverse direction in a predetermined and constant cycle of displacement by an eccentric cam 81 mounted on the side of the warp knitting machine. The pattern guide bar 62 is mounted, as is the conventional, on the superstructure 30 which is oscillatable backwards and forwards in the swing direction A—A about beam 34. The thread guides 62 which are slidably attached to the pattern guide bar 50 can be clamped to and released from said bar by means of clamping device 70.

When the pattern bar 50 commences its traverse movements the thread guides 62 are carried with it. Their path in the traverse direction is however limited by the tabs 48 in that a tab 57 connected to a thread guide 62 is stopped by tab 48 connected to a jacquard dropper pin 42 (which is activated by a jacquard head not shown in the conventional manner) while the bar 50 completes its normal traverse motion. At this moment the thread guide 62 which is controlled by tab 48 attached to tab bar 40 is clamped onto bar 50 by clamping means 70 and the bar 50 then carries through the swinging motion of superstructure 30. The tab bar 40 which carries tab 48 is similarly attached to superstructure 30. After the completion of the lapping movement of the thread guide 62 it is carried with the returning movement of pattern guide bar 50 and this motion is again restricted by a correspondingly activated jacquard tab 48.

In addition to the foregoing controlled motions the machine is suitably provided with a ground stitch bar 20 which knits the ground stitches in a conventional manner.

Figure 2:
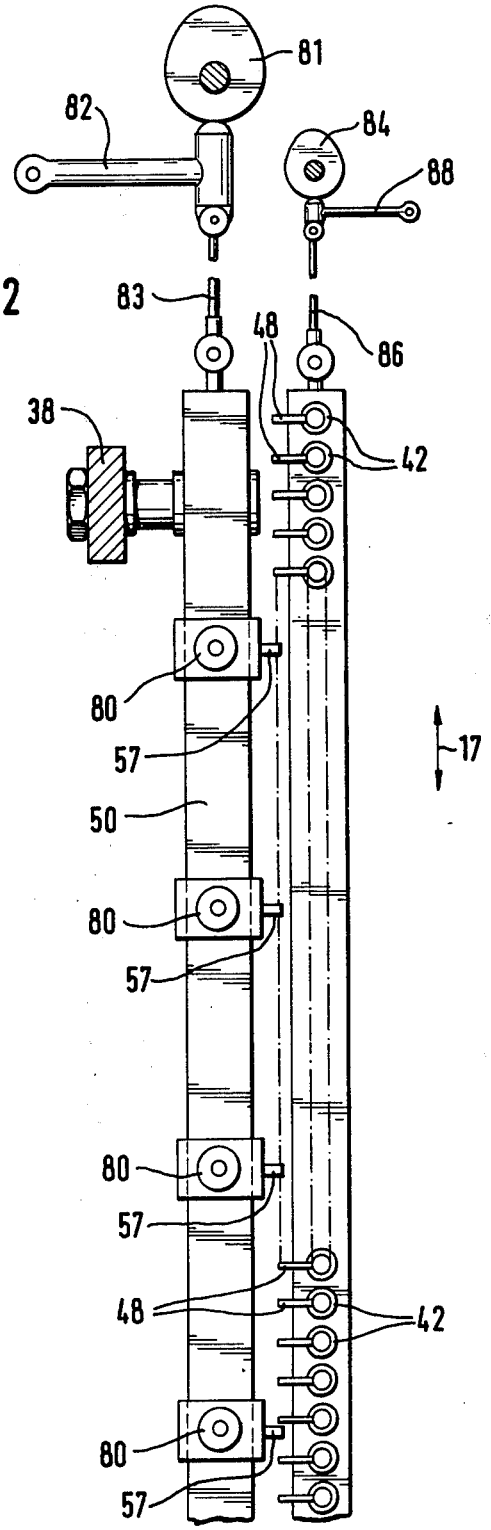
FIG. 2 is a partial plan view of FIG. 1 viewed from II—II.

The drawing of FIG. 2 is a partial plan of view of the pattern of bar 50 and the jacquard controlled tabs 48. To the guide bar 50 is attached a push rod 83, having connected thereto a connecting lever 82 which rides on eccentric cam 81. The rotation of the circular but eccentric cam 81 provides a regular back and forth movement to pattern bar 50. The jacquard tab bar 40 (which is not shown in FIG. 2) which carries the jacquard controlled tabs 48 similarly is driven by eccentric cam 84 on which lever 88 rides. Push rod 86 is connected to lever 88 and bar 40.

The apparatus operates in the following manner. As mentioned above pattern bar 50 executes its regular backwards and forwards motion by the action of the eccentric cam 81 which gives to it the maximum displacement required for the formation of the desired pattern. Where the selection of other patterns call for, a greater or lesser displacement, then a different eccentric cam 81 is utilized. When the displacement commences in the direction of arrow 17 several thread guides 52 are clamped onto guide bar 50 by a clamping mechanism 70 and of course follow the movement thereof. If, in accordance with the desired pattern, the displacement of one or another of the thread guides 52 is to be made smaller than the maximum displacement of bar 50 than by action of the jacquard arrangement (not shown) one or more of the tabs 48 are activated — that is to say, released — and by means of spring 43, moved downward so that they may contact with tab 57 attached to the appropriate guide 62. In this moment an electrical connection is interrupted which in turn releases the magnetic clamping means 90 which in turn causes the appropriate guide or guides to be held in the desired position while the bar 90 completes the maximum displacement to the end thereof. Thereupon the well known swing movement of superstructure 30 commences so that thread guides 62 complete their swing movement at the position foreseen in the predetermined pattern.

After the completion of the swinging motion the several thread guides 52 are clamped to guide bar 50 by the action of clamping means 90, which then moves in the opposite direction to that shown by arrow 17. Whereby it is then in a position for commencement of the next stitch row.

It will be understood that for reasons of structural strength the tabs 57 must have a finite but a substancial thickness. In order to compensate for this thickness and to insure that the appropriate guides 52 pass exactly between the needles on the needle bed, the jacquard bar 40 upon which the jacquard control tabs 48 are mounted is adjusted to compensate therefore by the motion of eccentric cam 84 acting through intermediate lever 88 on push bar 86.

I claim:

1. In a jacquard controlled warp knitting machine comprising (a) at least one needle bed provided with needles,
(b) at least one ground stitch guide bar having guides attached thereto,
(c) a plurality of jacquard droppers,
(d) a jacquard arrangement for controlling said jacquard droppers,
(e) at least one pattern guide bar, and
(f) drive means for said machine, the improvement which comprises
(i) a plurality of guides slidably mounted on said pattern guide bar,
(ii) tabs attached to guides, said tabs being positioned to be interactable with the jacquard droppers upon activation thereof by the jacquard arrangement,
(iii) clamping and declamping means for clamping said guides to and releasing said guides from said pattern guide bar,
(iv) activating means for activating and deactivating said clamping means.

2. A device in accordance with claim 1 wherein the activating means are electromagnetically controlled.

3. A device according to claim 1 wherein the activating means are mechanically controlled.

4. A device in accordance with claim 3 wherein the activating means are controlled by the jacquard arrangement.

5. A device according to claim 1 wherein said jacquard droppers influencing said guides are mounted on a jacquard tab bar.

6. A device according to claim 5 wherein said tab bar is displacable in the traverse direction and also moveable in the swing direction.

7. A device in accordance with claim 1 wherein said pattern guide bar bearing the slidably mounted guides is drivably connected to a drive means providing a constant preselected displacement cycle.

8. A device in accordance with claim 1 additionally comprising a second pattern bar having a guide bar and having tabs slidably mounted thereon, said second guide bar being mounted in the machine and connected to the displacement control means thereof so as to be 180° out of phase with the first pattern guide bar.

9. A device according to claim 1 wherein a maximum displacement executable by the tab bar exceeds the maximum underlap displacement of the guides associated therewith.

* * * * *